US009957019B2

(12) United States Patent
Sciarra

(10) Patent No.: US 9,957,019 B2
(45) Date of Patent: May 1, 2018

(54) FOLDING RECREATIONAL BOARD

(71) Applicant: Joe Sciarra, Corona del Mar, CA (US)

(72) Inventor: Joe Sciarra, Corona del Mar, CA (US)

( * ) Notice: Subject to any disclaimer, the term of this patent is extended or adjusted under 35 U.S.C. 154(b) by 0 days. days.

(21) Appl. No.: 15/396,742

(22) Filed: Jan. 2, 2017

(65) Prior Publication Data

US 2017/0144735 A1 May 25, 2017

Related U.S. Application Data

(63) Continuation-in-part of application No. 14/741,415, filed on Jun. 16, 2015, now abandoned.
(Continued)

(51) Int. Cl.
*B63B 35/81* (2006.01)
*A63C 5/03* (2006.01)
(Continued)

(52) U.S. Cl.
CPC ..... *B63B 35/7916* (2013.01); *A45F 3/04* (2013.01); *A45F 3/14* (2013.01); *A45F 3/15* (2013.01);
(Continued)

(58) Field of Classification Search
CPC . B63B 35/79; B63B 35/7906; B63B 35/7916; B63B 35/7926; B63B 2035/79;
(Continued)

(56) References Cited

U.S. PATENT DOCUMENTS 3,137,873 A * 6/1964 Garrolini ..... B63B 35/7916 441/74
3,287,754 A * 11/1966 Price ..... B63B 35/7916 156/245
(Continued)

FOREIGN PATENT DOCUMENTS

DE 3143769 A1 * 5/1983 ..... B63B 35/7916
JP 11059574 A * 3/1999 ..... A63C 5/02
(Continued)

OTHER PUBLICATIONS

Lopes Bonna C E, Foldable surfboard, is provided with buckles, hinges, locks, latches and slots, where surfboard is made of polyurethane and fiberglass, Derwent-Acc-No. 2011-B84930, Derwent-Week: 201123, Copyright 2017 Thomson Reuters, Pub-No. BR-200901671-A2, Jan. 25, 2011, Abst 2 pages,1 DWG. (Year: 2009).*

*Primary Examiner* — Daniel V Venne
(74) *Attorney, Agent, or Firm* — John R. Ross; John R. Ross, III

(57) ABSTRACT

A foldable recreational board that can be formed into a ridable board for riding and then folded when finished for easy transportation or storage. The foldable recreational board has foam sections covered by a flexible skin. The flexible skin includes a closing and opening mechanism. When the closing and opening mechanism is closed the skin is held very tight around the foam sections so that the foam sections are squeezed together tightly to form a ridable board. When the closing and opening mechanism is opened, pressure is released from the foam sections and the recreational board can be folded. In a preferred embodiment there are three foam sections and the opening and closing mechanism is two zippers attached to a ½ inch thick flexible neoprene skin.

9 Claims, 4 Drawing Sheets

Related U.S. Application Data

(60) Provisional application No. 62/012,846, filed on Jun. 16, 2014.

(51) Int. Cl.

| | |
|---|---|
| ***B63B 35/79*** | (2006.01) |
| ***A45F 3/04*** | (2006.01) |
| ***A45F 3/14*** | (2006.01) |
| ***A45F 3/15*** | (2006.01) |
| ***A63C 5/02*** | (2006.01) |
| *A45F 3/00* | (2006.01) |
| *B63B 7/00* | (2006.01) |

(52) U.S. Cl.

CPC ..... *A63C 5/02* (2013.01); *B63B 35/7906* (2013.01); *A45F 2003/003* (2013.01); *B63B 2007/003* (2013.01); *Y10T 29/49828* (2015.01)

(58) Field of Classification Search

CPC ..... B63B 2035/7903; B63B 2231/40; A63C 5/02

USPC ..... 441/65, 74, 79; 114/352, 353, 354, 355

See application file for complete search history.

(56) References Cited

U.S. PATENT DOCUMENTS

| | | | | | |
|---|---|---|---|---|---|
| 3,339,607 | A * | 9/1967 | Howard | B63B 35/7946 | 114/79 R |
| 4,719,952 | A * | 1/1988 | Geronimo | B63B 35/7933 | 114/219 |
| 5,147,235 | A * | 9/1992 | Bamburak | B63B 35/7946 | 114/361 |
| 6,003,745 | A * | 12/1999 | Mechanic | A45C 9/00 | 206/315.1 |
| 8,734,308 | B1 * | 5/2014 | Joslin | A63B 22/16 | 482/142 |
| 8,910,959 | B2 * | 12/2014 | Alva | A63C 17/015 | 280/87.05 |
| 2005/0023177 | A1 * | 2/2005 | Kiger | B63B 35/7946 | 206/522 |
| 2009/0283436 | A1 * | 11/2009 | Carcamo | B63B 35/7946 | 206/522 |
| 2010/0006469 | A1 * | 1/2010 | Allouche | B63B 35/7946 | 206/523 |
| 2012/0118766 | A1 * | 5/2012 | Baker | B63B 35/7946 | 206/315.1 |
| 2012/0137953 | A1 * | 6/2012 | Murray | B63B 17/00 | 114/361 |

FOREIGN PATENT DOCUMENTS

| | | | | |
|---|---|---|---|---|
| WO | WO-0024631 | A1 * | 5/2000 | B63B 7/02 |
| WO | WO-2009070525 | A1 * | 1/2009 | B22F 3/03 |
| WO | WO-2011119508 | A1 * | 9/2011 | A63C 17/015 |

* cited by examiner

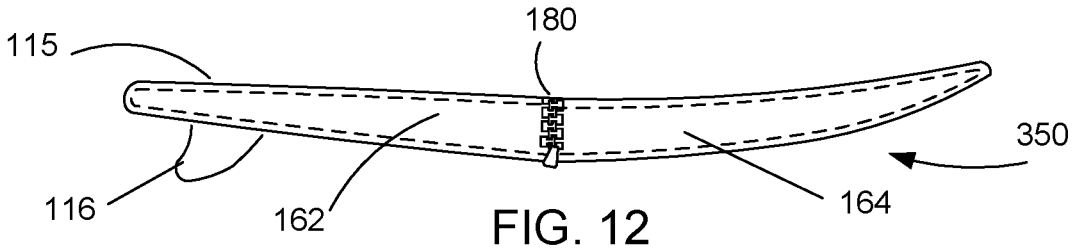
FIG. 12
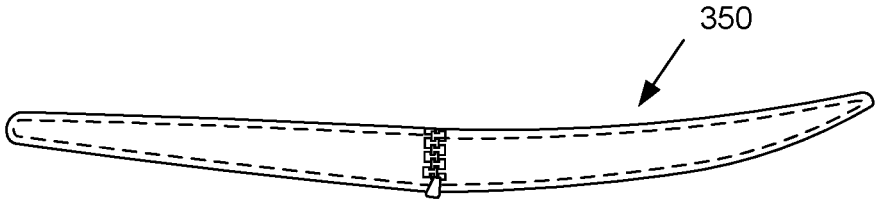
FIG. 13
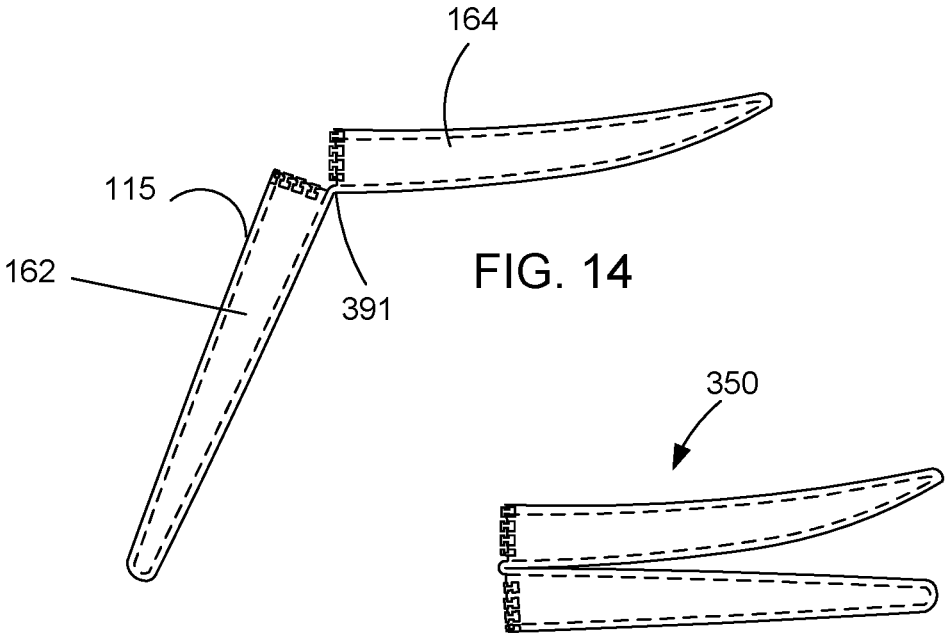
FIG. 14
FIG. 15

FOLDING RECREATIONAL BOARD

The present invention relates to recreational boards, and in particular, to recreational boards used in the water. The present invention is a Continuation-in-Part (CIP) of U.S. application Ser. No. 14/741,415, filed Jun. 16, 2015; which claims the benefit of U.S. Provisional Application No. 62/012,846, filed on Jun. 16, 2014. Both of these United States patent applications are incorporated herein by reference herein in their entireties.

BACKGROUND OF THE INVENTION

Recreational water boards, such as paddle boards, surfboards and body hoards are known in the prior art. These type of boards are very enjoyable for many adults and children. Modern boards are usually fabricated from foam and are not very heavy. Often, however, they are very large in size and take up significant space. The boards need to have sufficient size to support and adequately float a human being. This can make it difficult to transport a board to the water, carry the board, fit a board in an automobile or conveniently store the board at the user's home.

As stated above, prior art bodyboards, paddle boards and surfboards are commonly fabricated from foam core. The foam may then be covered in a layer of fiberglass to increase strength, durability and to help prevent water absorption in the foam. Foam types may vary. A common choice of surfboard foam includes Polyurethane (PU), Polystyrene (PS) or Expanded Polystyrene (EPS) foam.

Bodyboard foam may include extruded polyethylene. Polypropylene offers extruded and beaded models. Memory is the most important advantage of this core bodyboard material. Polyethylene is water resistant, durable and light weight.

Board foam may also be 70% polystyrene and 30% polyethylene. Bodyboards made of this combination keep the original shape longer and its stiffness level is excellent.

What is needed is an improved recreational board that is easily transportable and storable.

SUMMARY OF THE INVENTION

The present invention provides a foldable recreational board that can be formed into a ridable board for riding and then folded when finished for easy transportation or storage. The foldable recreational board has foam sections covered by a flexible skin. The flexible skin includes a closing and opening mechanism. When the closing and opening mechanism is closed the skin is held very tight around the foam sections so that the foam sections are squeezed together tightly to form a ridable board. When the closing and opening mechanism is opened, pressure is released from the foam sections and the recreational board can be folded. In a preferred embodiment there are three foam sections and the opening and closing mechanism is two zippers attached to a ½ inch thick flexible neoprene skin.

BRIEF DESCRIPTION OF THE DRAWINGS

FIG. 12 shows another preferred board ready for riding.
FIG. 13 shows a preferred board with skeg removed.
FIG. 14 shows a preferred board that is being folded.
FIG. 15 shows a preferred board that has been folded.

DETAILED DESCRIPTION OF THE PREFERRED EMBODIMENTS

Figure 1:
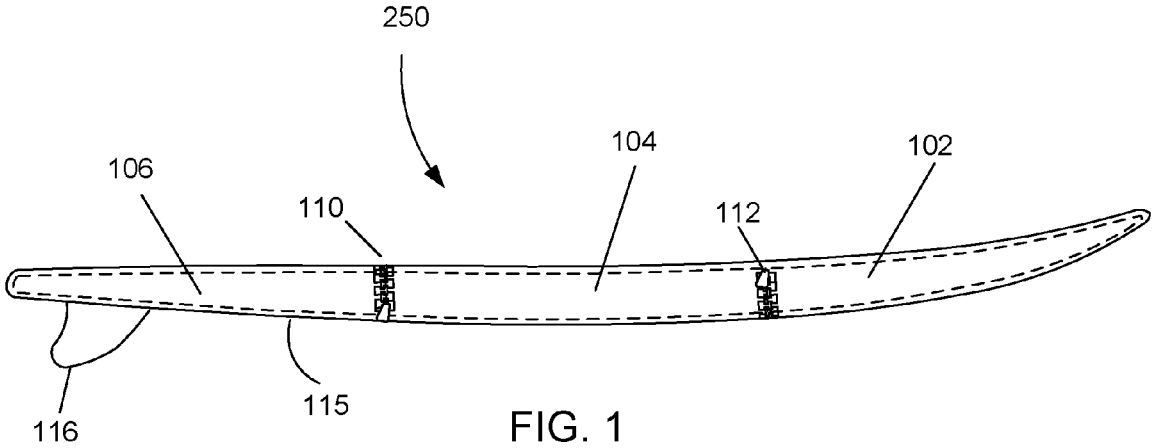
FIG. 1 shows a preferred board ready for riding.
Figure 2:
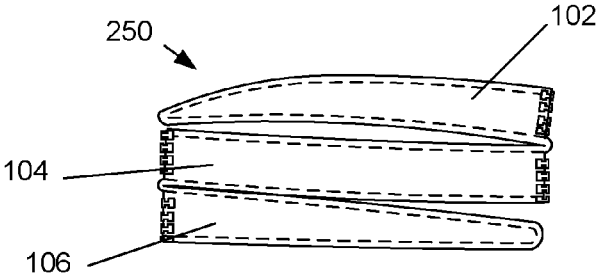
FIG. 2 shows a preferred board that is folded.
Figure 4:
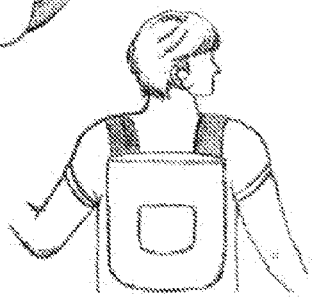

FIG. 1 shows a preferred embodiment of preferred segmented paddle board 250. In the preferred embodiment, rear foam section 106, middle foam section 104 and front foam section 102 are placed inside neoprene skin 115. Skin 115 includes a closing and opening mechanism for closing skin 115 tightly around the foam sections to squeeze the foam sections together to form a ridable board 250 and then also for providing an opening in skin 215 to release pressure on the foam sections to allow board 250 to be folded. For example, in a preferred embodiment, skin 115 is zipped tightly together using zippers 110 and 112 so that stiff, functional paddle board 250 is created. Skin 115 includes an opening so that fin 116 can be rigidly connected to rear foam section 106. In a preferred embodiment, board 250 is folded as shown in FIG. 2 when not being used in the water. After board 250 is folded, it can then be easily stored or transported. For example, in one preferred embodiment the user places board 250 into backpack 252. Skeg 116 is placed into pocket 254. Board 250 may then be easily transported by one individual, as shown in FIG. 4.

Assembling a Preferred Board

Figure 5:
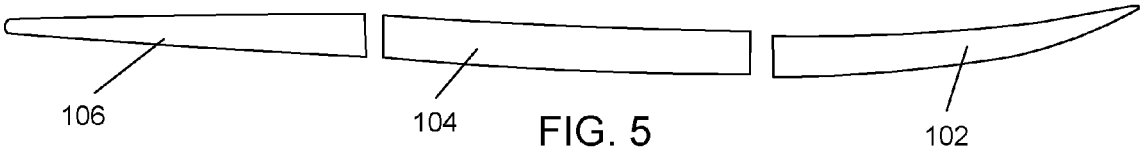
FIG. 5 shows preferred foam sections.

In FIG. 5, the user has acquired rear foam section 106, middle foam section 104 and front foam section 102. Each of the foam sections are detached from each other. In a preferred embodiment foam sections 102, 104 and 106 are a 70% polystyrene and 30% polyethylene foam.

Figure 6:
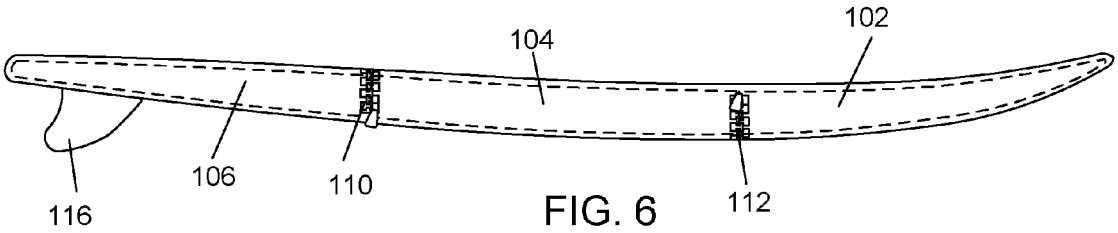
FIG. 6 shows a preferred board ready for riding.
Figure 10:
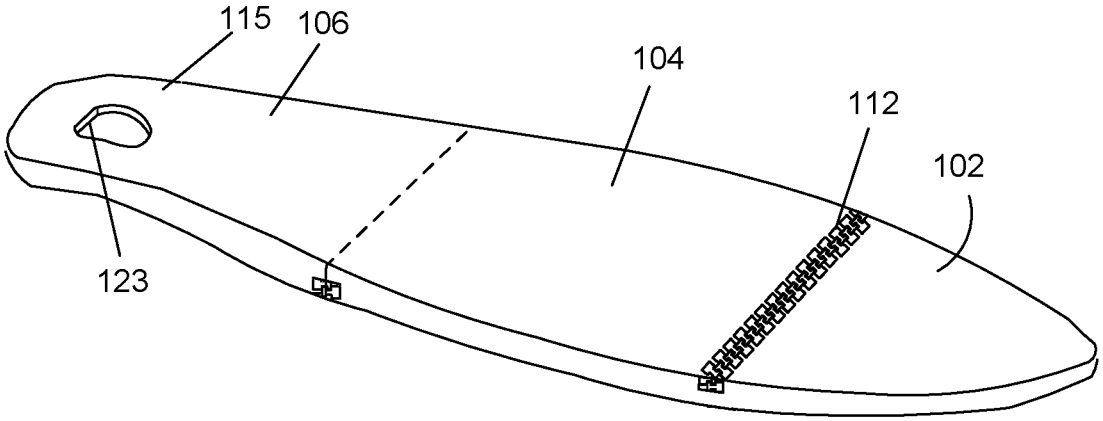
FIG. 10 shows a bottom side of a preferred board.
Figure 11:
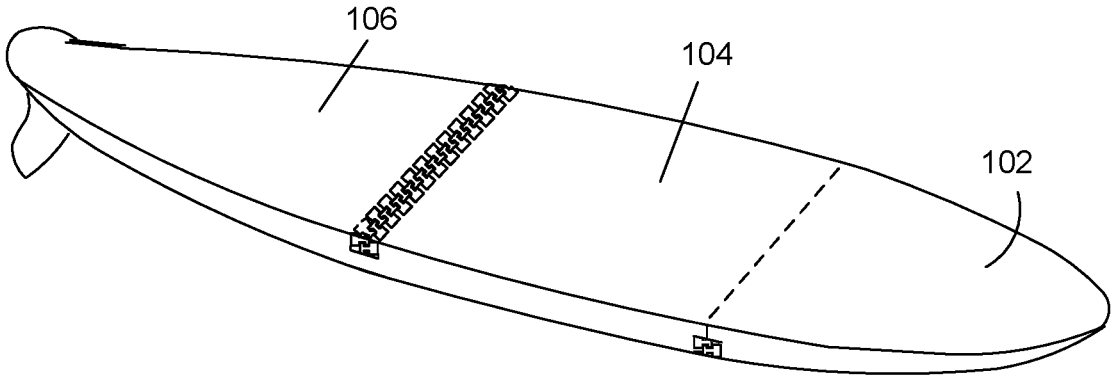
FIG. 11 shows a top side of a preferred board.

In FIG. 6, the user has inserted foam sections 102, 104, and 106 into neoprene skin 115. Neoprene skin is preferably approximately ½ inch thick and includes zippers 110 and 112. Neoprene skin is strong and flexible so that it forms tightly around foam sections 102, 104 and 106 after being zipped shut. Accordingly, after the user has inserted foam sections 102, 104, and 106 the user zips zippers 110 and 112 shut so that foam sections 102, 104 and 106 are squeezed tightly close together as shown to form board 250. The user has also attached skeg 116 through opening 123 in skin 115 (see also FIGS. 10-11). The user is now able to use board 250 in the water.

Folding a Preferred Board for Transport or Storage

Figure 7:
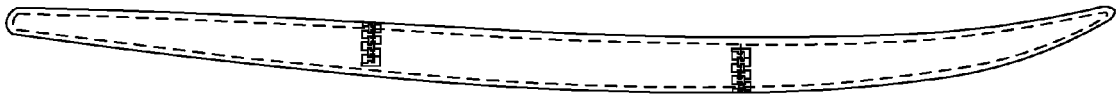
FIG. 7 shows a preferred board after a skeg has been removed.

In FIG. 7, the user has finished using board 250 and is ready to transport it away from the water. The user has removed skeg 116 from foam section 106.

Figure 8:
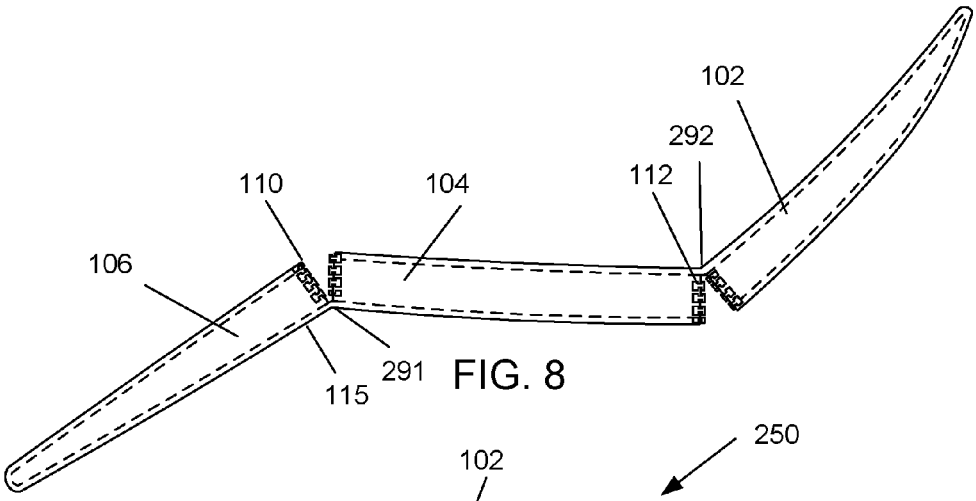
FIG. 8 shows a preferred board that is being folded.

In FIG. 8 the user has unzipped zippers 110 and 112. The user has also begun to fold board 250. For example, rear foam section 106 is pivoting counterclockwise about hinge 291 formed by skin 115 between rear section 106 and middle section 104. Front section 102 is pivoting counter clockwise about a hinge formed by skin 115 between front section 102 and middle section 104.

Figure 3:
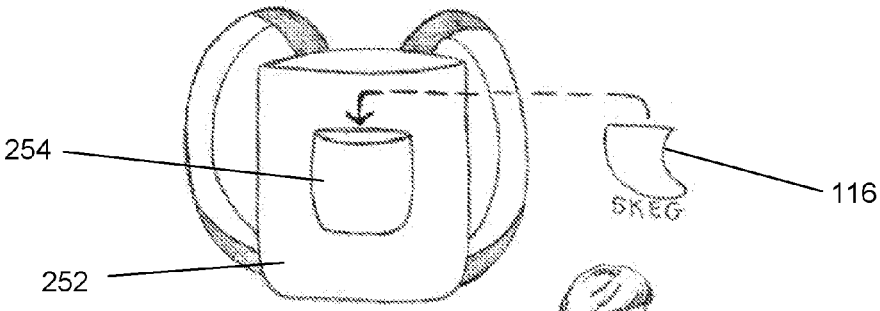
FIGS. 3-4 show a backpack for carrying a folded board.
Figure 9:
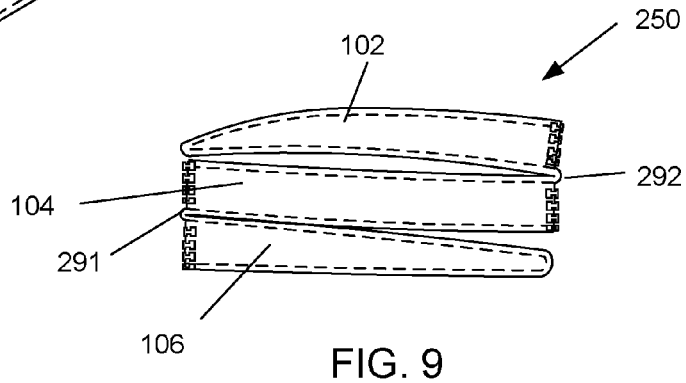
FIG. 9 shows a preferred board that has been folded.

In FIG. 9, the user has finished folding board 250 so that it is now easily transportable and storable. For example, board 250 will now fit easily into the back of a small car or fit easily into an ordinary backpack (FIGS. 3-4).

It should be noted that the size of foam sections 102, 104 and 106 and the size of skin 115 may vary depending on the wishes of the user and the ultimate desired size of board 250. For example in one preferred embodiment foam sections 102, 104 and 106 have a width of approximately 18 inches and a length of approximately 23 inches. Also in a preferred embodiment foam sections 102 may have an average thickness of approximately 1.5 inches.

Preferred Board Having Two Foam Sections

Assembling a Preferred Board

In FIG. 12, the user has inserted rear foam section 162 and front foam section 164 into neoprene skin 115. Neoprene skin 115 is preferably approximately ½ inch thick and includes zipper 180. After the user has inserted foam sections 162 and 164 into skin 115 the user zips zippers 180 shut so that foam sections 162 and 164 are held tightly close together as shown to form board 350. The user has also attached skeg 116 through an opening in skin 115. The user is now able to use board 350 in the water.

Folding a Preferred Board for Transport or Storage

In FIG. 13, the user has finished using board 350 and is ready to transport it away from the water. The user has removed skeg 116 from foam section 162.

In FIG. 14 the user has unzipped zipper 180. The user has also begun to fold board 350. For example, rear foam section 162 is pivoting counterclockwise about hinge 391 formed by skin 115 between rear section 162 and front section 164.

In FIG. 15, the user has finished folding board 350 so that it is now easily transportable and storable. For example, board 350 will now fit easily into the back of a small car or fit easily into an ordinary backpack (FIGS. 3-4).

While the present invention has been described in terms of preferred embodiments, the reader should consider these described embodiments only as particular embodiments. Many other embodiments are possible. Therefore, the reader should determine the scope of the present invention by the claims and their legal equivalents.

What is claimed is:

1. A foldable recreational board that can be formed into a ridable board for riding and folded for easy storage or transportation, comprising:

A) a plurality of foam sections,

B) a flexible skin covering said plurality of foam sections, and

C) at least one closing and opening mechanism for closing said flexible skin tightly around said plurality of foam sections squeezing said plurality of foam sections together to form said ridable board and for providing an opening in said flexible skin, wherein a hinge is formed in said flexible skin between said plurality of foam sections allowing said plurality of foam sections to be folded.

2. The board as in claim 1, wherein said plurality of foam sections is two foam sections.

3. The board as in claim 1, wherein said plurality of foam sections is three foam sections.

4. The board as in claim 1, where said plurality of foam sections are detached from one another.

5. The board as in claim 1, wherein said flexible skin is a neoprene skin.

6. The board as in claim 5, wherein said neoprene skin is approximately ½ inch thick.

7. The board as in claim 1, wherein said at least one closing and opening mechanism is at least one zipper.

8. The board as in claim 1, wherein said at least one closing and opening mechanism is two zippers.

9. A foldable recreational board that can be formed into a ridable board for riding and folded for easy storage or transportation, comprising:

A) a plurality of foam sections,

B) a flexible skin covering said plurality of foam sections, and

C) at least one closing and opening mechanism for closing said flexible skin tightly around said plurality of foam sections squeezing said plurality of foam sections together to form said ridable board and for providing an opening in said flexible skin, wherein said flexible skin comprises a skeg opening for allowing the connection of a skeg to one of said plurality of foam sections.

* * * * *